US006108433A

United States Patent [19]

Norris

[11] Patent Number: 6,108,433

[45] Date of Patent: Aug. 22, 2000

[54] METHOD AND APPARATUS FOR A MAGNETICALLY INDUCED SPEAKER DIAPHRAGM

[75] Inventor: Elwood G. Norris, Poway, Calif.

[73] Assignee: American Technology Corporation, San Diego, Calif.

[21] Appl. No.: 09/006,689

[22] Filed: Jan. 13, 1998

[51] Int. Cl.[7] ..... H04R 25/00

[52] U.S. Cl. ..... 381/399; 381/406; 381/408; 381/162; 381/360; 367/140

[58] Field of Search ..... 381/162, 163, 381/164, 360, 368, 176, 177, 395, 421, 429, 406, 408; 367/140

[56] References Cited

U.S. PATENT DOCUMENTS

| | | | |
|---|---|---|---|
| 1,643,791 | 4/1924 | Slepian | 381/408 |
| 3,012,107 | 12/1961 | Hanlet | 381/408 |
| 4,295,214 | 10/1981 | Thompson | 367/140 |
| 4,480,155 | 10/1984 | Winey | 179/115.5 |
| 4,593,567 | 6/1986 | Isselstrein et al. . | |
| 4,621,171 | 11/1986 | Wada et al. | 381/113 |
| 4,803,733 | 2/1989 | Carver et al. . | |
| 4,837,838 | 6/1989 | Thigpen et al. . | |
| 4,908,805 | 3/1990 | Sprenkels et al. . | |
| 4,939,784 | 7/1990 | Bruney . | |
| 5,357,578 | 10/1994 | Taniishi . | |
| 5,430,805 | 7/1995 | Stevenson et al. | 381/203 |
| 5,487,114 | 1/1996 | Dinh | 381/406 |
| 5,748,758 | 5/1998 | Menasco, Jr. et al. | 381/176 |
| 5,889,870 | 3/1999 | Norris | 381/77 |

OTHER PUBLICATIONS

Masahide Yoneyama, Jun–ichiroh Fujimoto, Yu Kawamo, Shoichi Sasabe "Audio Spotlight: An Application of Nonlinear Interaction of Sound Waves to a New Type of Loudspeaker Design" J. Acoustical Society of America 73(5), May 1983, pp. 1532–1536.

H.O. Berktay, T.G. Muir "Arrays of Parametric Receiving Arrays" The Journal of the Acoustical society of America, pp. 1377–1383.

Kenichi Aoki, Tomoo Kamakura, Yoshiro Kumamoto "Parametric Loudspeaker—Characteristics of Acoustic Field and Suitable Modulation of Carrier Ultrasound" Electronics and Communications in Japan, Part 3, vol. 74, No. 9, 1991, pp. 76–80.

*Primary Examiner*—Curtis A. Kuntz
*Assistant Examiner*—Dionne N. Harvey
*Attorney, Agent, or Firm*—Thorpe, North & Western, LLP

[57] ABSTRACT

An ultrasonic emitter device having broad frequency range capacity with relatively large diaphragm displacement compared to typical electrostatic diaphragm movement. The device includes a core member able to establish a variable magnetic field adjacent the core member. A movable diaphragm is stretched along and displaced a short separation distance from the core member to allow an intended range of orthogonal displacement of the diaphragm within a strong portion of the magnetic field. At least one conductive ring disposed on the movable diaphragm within the influence of the variable magnetic field of the core member for enabling current flow through the ring for developing a second magnetic field which interacts with the first magnetic field to repel and relax the diaphragm at a desired frequency for development of a series of compression waves which may be adjusted to include an ultrasonic frequency range.

32 Claims, 4 Drawing Sheets

METHOD AND APPARATUS FOR A MAGNETICALLY INDUCED SPEAKER DIAPHRAGM

BACKGROUND OF THE INVENTION

1. Field of the Invention

This invention pertains to propagation of ultrasonic frequencies from a thin, flexible diaphragm emitter. Specifically, the present invention relates to a speaker device and method for directly generating sonic and ultrasonic compression waves, and more importantly, for indirectly generating a new sonic or subsonic compression wave by interaction of two ultrasonic signals having frequencies whose difference in value corresponds to the desired new sonic or subsonic compression wave frequencies.

2. State of the Art

Many attempts have been made to reproduce sound in its pure form. In a related patent application under Ser. No. 08/684,311, a detailed background of prior art in speaker technology using conventional speakers having radiating elements was reviewed and is hereby incorporated by reference. FIG. 1 illustrates a graphic representation of a conventional audio speaker 10 using a moveable diaphragm 14. Diaphragm movement 18 is regulated by energy from a magnetic core 21 which drives a stator 22 in a reciprocating manner within an annular recess of the coil. The conversion of electrical signal to sonic compression wave is developed by the variable current or voltage 23 applied to the stator, resulting in a variable magnetic field which causes attraction or repulsion with respect to the magnetic core. The diaphragm attached to the stator is displaced to mechanically reproduce the variable frequency and amplitude of the electrical signal in the form of a compression wave. Amplitude of the compression wave is primarily a function of the diameter of the diaphragm, and extent of orthogonal displacement 18. Physically, this corresponds to the volume of air being moved with each stroke of the speaker membrane.

The primary disadvantage with use of such conventional speakers is distortion arising from the mass of the moving diaphragm or other radiating component. Related problems arise from distortion developed by mismatch of the radiator element across the spectrum of low, medium and high range frequencies—a problem partially solved by the use of combinations of woofers, midrange and tweeter speakers.

Attempts to reproduce sound without use of a moving diaphragm include technologies embodied in parametric speakers, acoustic heterodyning, beat frequency interference and other forms of modulation of multiple frequencies to generate a new frequency. In theory, sound is developed by the interaction in air (as a nonlinear medium) of two ultrasonic frequencies whose difference in value falls within the audio range. Ideally, resulting compression waves would be projected within the air as a nonlinear medium, and would be heard as pure sound. Despite the ideal theory, general production of sound for practical applications has alluded the industry for over 100 years.

Specifically, a basic parametric or heterodyne speaker has not been developed which can be applied in general applications in a manner such as conventional speaker systems. A significant limitation with prior art parametric speaker systems is lack of sufficient amplitude. Ultrasonic frequencies have comparatively small wave lengths and are generally characterized by nominal diaphragm displacement. This limited movement of the diaphragm or emitter membrane contributes to inadequate volume for the parametric output, as well as lack of extended range for projection of the resulting sonic waves generated by interference of the two ultrasonic frequencies. It is not surprising that amplitude would be a problem in such a system where frequencies in excess of 40,000 Hz tend to limit the excursion length for diaphragm displacement.

A brief history of development of the theoretical parametric speaker array will be helpful with respect to enhancing an appreciation for the confusion and inadequacies of prior efforts for increasing amplitude from an acoustic heterodyne system. For example, a general discussion of this technology is found in "Parametric Loudspeaker—Characteristics of Acoustic Field and Suitable Modulation of Carrier Ultrasound", Aoki, Kamadura and Kumamoto, *Electronics and Communications in Japan, Part* 3, *Vol.* 74, *No.*9 (March 1991). Although technical components and the theory of sound generation from a difference signal between two interfering ultrasonic frequencies is described, the practical realization of a commercial sound system was apparently unsuccessful. Note that this weakness in the prior art remains despite the assembly of a parametric speaker array consisting of as many as 1410 piezoelectric transducers yielding a speaker diameter of 42 cm. Virtually all prior research in the field of parametric sound has been based on the use of conventional ultrasonic transducers, typically of bimorph piezoelectric character. The rigid piezoelectric emitter face of such transducers has very little displacement, and is accordingly limited in amplitude.

U.S. Pat. No. 5,357,578 issued to Taniishi in October of 1994 introduced alternative solutions to the dilemma of developing a workable parametric speaker system. Here again, the proposed device comprises a transducer which radiates the dual ultrasonic frequencies to generate the desired audio difference signal. However, this time the dual-frequency, ultrasonic signal is proparated from a gel medium on the face of the transducer. This medium 20 "serves as a virtual acoustic source that produces the difference tone 23 whose frequency corresponds to the difference between frequencies f1 and f2." Col 4, lines 54–60. In other words, this 1994 reference abandons direct generation of the difference audio signal in air from the face of the transducer, and depends upon the nonlinearity of a gel medium itself to produce sound. This abrupt shift from transducer/air interface to proposed use of a gel medium reinforces the perception of apparent inoperativeness of prior art disclosures, at least for practical speaker applications.

Electrostatic emitters for ultrasonic wave generation have been applied in many areas of technology, but have equally limited diaphragm displacement. For example, U.S. Pat. No. 4,439,642 discloses ultrasonic emitters in range finder devices for cameras and distance measuring devices produce high frequencies, but with very little amplitude. U.S. Pat. No. 5,287,331 illustrates devices which can generate extremely high frequencies up to 2 MHZ, but have an orthogonal displacement in micrometers. Because of the weakness of electrostatic forces, it is generally expected that diaphragm displacement will be nominal, as will be the resulting amplitude of ultrasonic or parametric sonic output.

What is needed is a system that combines the substantial mechanical movement of conventional audio speakers which are magnetically driven, with the high frequency capacity of an electrostatic speaker which operates well at frequencies within the ultrasonic range.

OBJECTS AND SUMMARY OF THE INVENTION

It is an object of the present invention to provide a method and apparatus for indirectly generating new sonic and subsonic waves at acceptable volume levels from a region of air without use of conventional piezoelectric transducers as the ultrasonic frequency source.

It is another object to indirectly generate at least one new sonic or subsonic wave having commercially acceptable volume levels by using a magnetically driven, thin film emitter which emits a complex wave comprised of at least two ultrasonic signals having different frequencies equal to the at least one new sonic or subsonic frequency.

It is still another object to provide a thin film speaker diaphragm capable of developing a uniform wave front across a broad ultrasonic emitter surface.

A still further object of this invention is to provide an improved speaker diaphragm capable of generating high amplitude compression waves in response to electrical stimulation, yet which does not require a rigid diaphragm structure of a conventional audio speaker or ultrasonic transducer.

The above objects and others not specifically recited are realized through a method and apparatus for an ultrasonic emitter device having broad frequency range capacity with relatively large diaphragm displacement compared to typical electrostatic diaphragm movement, but with the other well-known advantages of electrostatic design. The device includes a core member able to establish a first magnetic field adjacent the core member. A movable diaphragm is stretched along the core member and displaced a short separation distance from the core member to allow an intended range of orthogonal displacement of the diaphragm with respect to the core member and within a strong portion of the magnetic field. At least one, low mass, planar, conductive ring is disposed on the movable diaphragm and includes means for inductively supplying variable current flow to the at least one ring for developing a second magnetic field which variably interacts with the first magnetic field to attract and repel the diaphragm at a desired frequency for development of a series of compression waves which may include an ultrasonic frequency range.

Other objects, features, advantages and alternative aspects of the present invention will become apparent to those skilled in the art from a consideration of the following detailed description, taken in combination with the accompanying drawings.

DETAILED DESCRIPTION OF THE INVENTION

Figure 1:
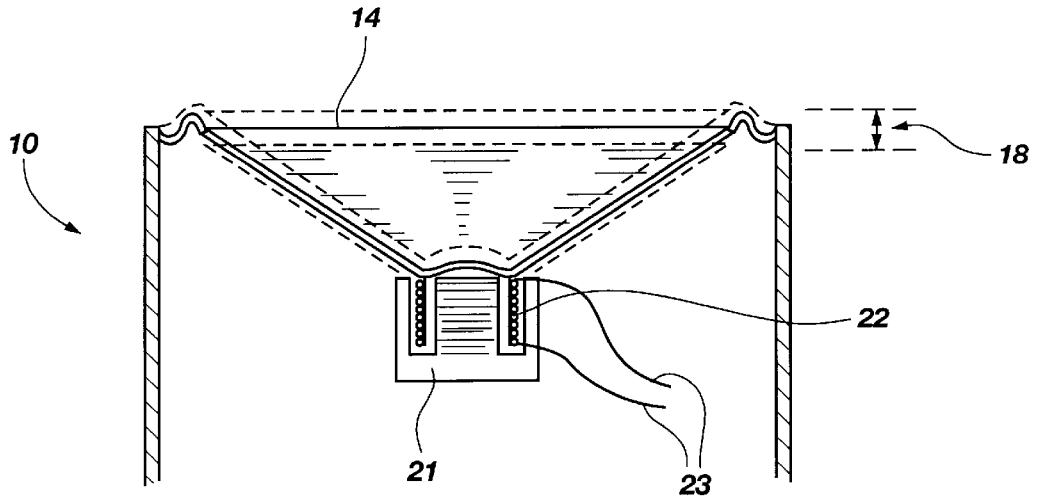
FIG. 1 is a cross-sectional, side view in graphical representation of a conventional audio speaker having a magnetic core and moveable diaphragm.
Figure 2:
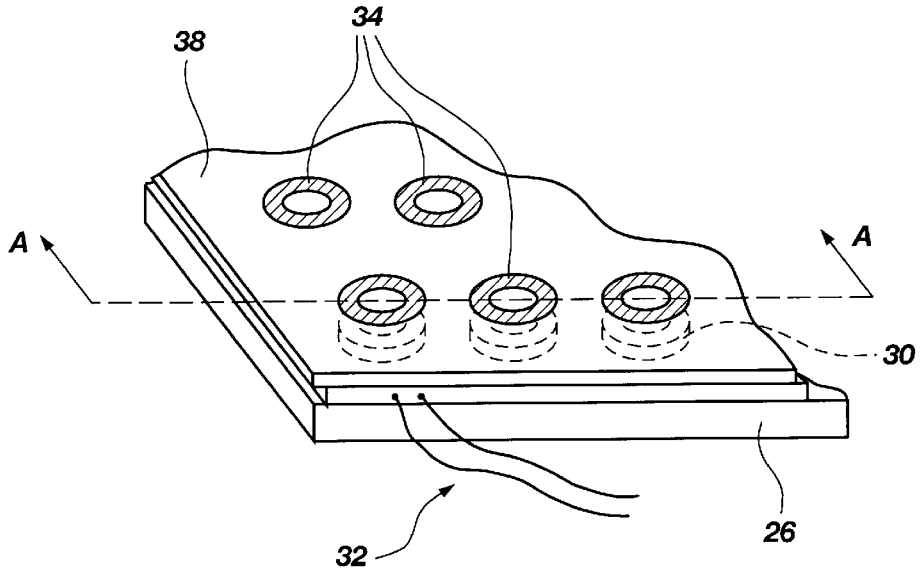
FIG. 2 is a cut-away, top perspective view showing a thin film diaphragm having a plurality of rings disposed on the emitter diaphragm and suspended over a core element in accordance with the principles of the present invention.

FIG. 2 depicts one of the preferred conceptual configurations of the present invention. Specifically, it comprises a core member 26 for giving rigid support, at least one conductive coil 30 coupled to the core, and a diaphragm 38 which includes a conductive ring 34 which responds to a magnetic field developed by the conductive coil. The operative principles in this structure are founded on the nature of a conductive ring to develop current flow when passed through a magnetic field. Specifically, when a conductive ring experiences a magnetic field gradient, a current will flow through the ring in an orientation which establishes a magnetic moment counter to the magnetic force generated by the coil. This phenomenon results in a repulsion between the coil and the conductive ring. Many physics students have observed the power of this repulsive force in classroom demonstrations which launch an aluminum ring twenty to thirty feet into the air.

The interaction between the coil 30 and the ring 34 is partially described by two principles of physics commonly known as *Faraday's Law of Induction and Lenz's Law.* See *Fundamentals of Physics,* Halliday and Resnick, Second Edition, Chapter 34. Faraday's law of induction describes the phenomenon of current being induced in a wire loop by a moving magnetic field. Lenz's law states that the induced current in the wire loop appears in such a direction that it opposes the change that produced it. Based on these two principles, the wire loop opposes the motion of the magnetic field. In other words, when a magnetic field is produced by increasing current flow through a coil, the magnetic field of the coil increases and, thus, a wire loop or ring adjacent to the increasing magnetic field opposes the increase in the magnetic field therethrough and experiences an opposing force from the coil. Alternatively, when a magnetic field is produced by decreasing current through a coil, the magnetic field of the coil decreases and the conductive ring adjacent to the decreasing magnetic field experiences a corresponding decrease in the opposing magnetic field therethrough.

The present inventor has applied this principle to generate a speaker diaphragm which variably extends and retracts to create a desired series of compression waves. By applying an array of conductive rings to a resilient, flexible film such as Mylar™ or Kapton™, etc., and superimposing this film over a corresponding array of conductive coils, it is possible to repel the film to a biased state of tension and, via modulation of the amplitude of current through the coils, to develop a controlled diaphragm oscillation. The resilience of the film allows its retraction to the biased rest position in which the film is in a slightly stressed, extended state. This biased, rest position is developed by a base or carrier signal of alternating current which maintains a minimum level of repulsion between the coils and rings.

A continuous input of variable alternating current which is modulated with intelligence enables translation of frequency and amplitude representing the intelligence into physical compression waves representing sound. Thus, a conventional modulated carrier such as a sinusoidal wave can be used to supply a desired audio output signal to the described magnetic film emitter to develop an effective speaker system.

This system also provides a unique capacity for use as an ultrasonic emitter having broad frequency range capacity with relatively large diaphragm displacement compared to the nominal movement of a typical electrostatic diaphragm. It has long been recognized that the limited range of movement of an electrostatic diaphragm (within the micrometer range for ultrasound) is a major hurdle to development of high amplitude output. The magnetically repelled film of the present invention, however, provides an orthogonal displacement (peak to peak movement of the diaphragm from a fully extended to a biased rest position) which may be as great as several millimeters. Therefore, the diaphragm displacement of the present invention compares very favorably with a substantially smaller movement range of a rigid transducer emitter face, or even the flexible diaphragm of a conventional electrostatic emitter.

Such enhanced displacement is possible because the effective range of a magnetic field extends much greater distances than the short range forces associated with an electrostatic field. It will therefore be noted that whereas the effective force of the electrostatic emitter may extend only in the range of micrometers, the magnetic diaphragm of the present invention has a greater range by a factor of more than one hundred. Therefore, the use of magnetic force is able to repel or attract an emitter diaphragm over a significantly greater excursion path.

The benefits of extended motion for the large magnetic diaphragm of the present invention include a significant increase in amplitude of sonic output for a parametric or acoustic heterodyne array, as compared to a comparable system of bimorphic transducers. It will be noted that amplitude appears to be enhanced by a factor of at least three in the mid-audio range, whereas high and low frequencies are improved by a factor of approximately two. Furthermore, near linear response is stronger with the film emitter, compared to the rigid transducers. These are significant factors that enable the field of parametric speakers to have enhanced commercial utility, whereas such utility has been somewhat limited to date.

Figure 3:
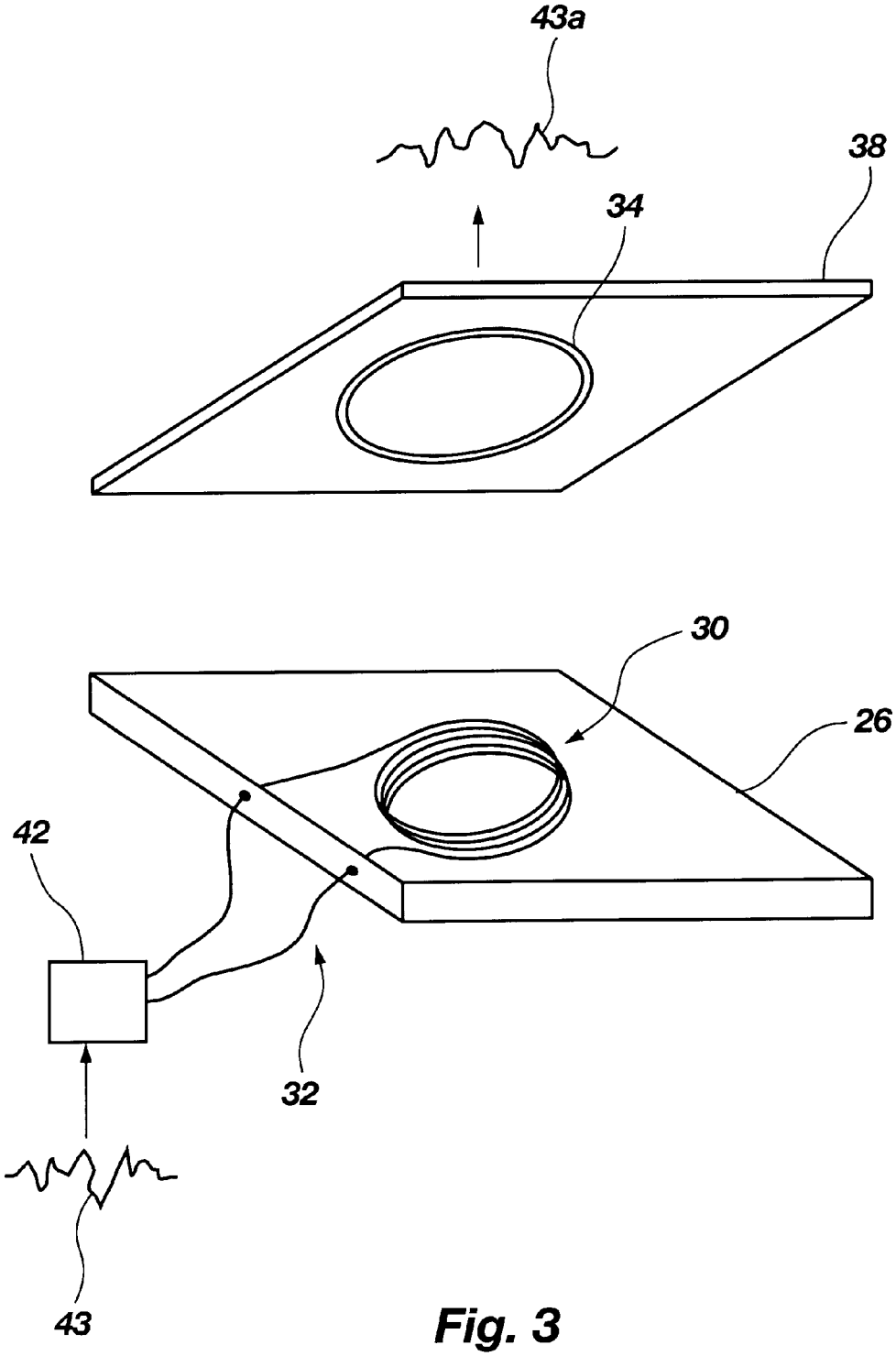
FIG. 3 is an exploded view of an embodiment showing a ring disposed on a diaphragm and a solenoid coil mounted in a core having leads for input of alternating current for controlling a magnetic field which propagates through the ring to generate repulsion within the diaphragm.
Figure 4:
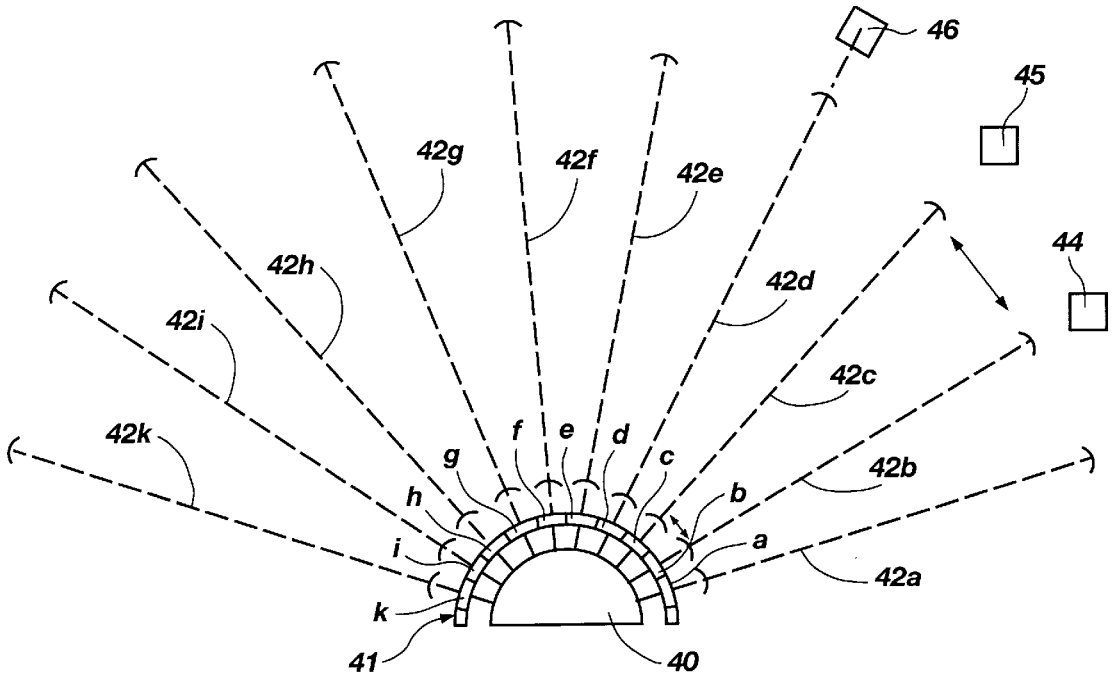
FIG. 4 is a graphic representation of a curved array of magnetic emitter elements configured for propagation of varieties of sound experience to a listening audience.

As noted above, the enhanced sonic output of the present invention is inductively enabled by use of conductive coils 30 positioned within a core or base member 26. As shown in FIG. 3, this core 26 includes at least one conductive coil 30 which generates a magnetic field from current input through leads 32. These leads are coupled to the modulated alternating current source (not shown). The core 26 provides the fixed support necessary to transfer oscillation energy to the movable diaphragm.

Such core and coil materials may be either flat or curved, and flexible or rigid, depending upon the configuration of the speaker array. For example, a planer plate will generate a column of sound which has surprising projection capacity over long distances. A curved emitter diaphragm may be formed and supported by a curved support as long as the magnetic field generated by the coil 30 extends into the center of ring 34 disposed in the diaphragm 38, or is otherwise configured to developed the desired counter magnetic moment.

This curved configuration provides a greater dispersion pattern for projected sound, and also enables a sense of lateral to emitted sound. This can be implemented by sequentially triggering sound transmission along a linear sequence of emitter elements (i.e., rings 34 above coils 30) disposed along the diaphragm 38. If all elements are concurrently activated, the dispersion pattern will simply appear to be a common wave front without a lateral directional aspect. However, if the array of rings is sequentially activated with a short time delay between separated rings, the resulting sound transmission will also be sequentially delayed.

Although such a curved speaker may have little time delay sequence in close proximity, the extended range of projected columns of sound by a parametric system provides the localized effect necessary for directional sound perception. This is illustrated in FIG. 3 which shows a radial sound projection pattern from a current and signal source 40. This power source also includes a microprocessor to control time delay and other parameters of signal generation. A magnetic speaker array 41 is configured in arcuate format with speaker segments isolated into a sequence of separate coil groups a through k. Because of the (i) tunneled or localized nature of projected parametric sound and (ii) by virtue of the diverging distance between each sound column 42*a* through 42*k,* an amazing simulation of moving sound source is developed.

This arises in part from an improved directionality of colimated sound which is projected from the film emitter groups "a" through "k". Instead of being promulgated in an omnidirectional manner as is customary with conventional sound systems, the improved parametric array sends individual columns of sound that can retain a narrow dispersion pattern for hundreds of feet. Therefore, at a distant target (44, 45, 46 etc), the sound level (SPL) from adjacent targets is significantly attenuated. The listener at location 42*b* therefore discerns the increasing volume with the angular approach of sound moving from 42*a* to 42*b*, and likewise hears the sound reduction as the column of sound shifts toward position 42*c*. A visual impact of seeing the responsive expression of other listeners experiencing the directionality of the moving sound further complements the impact of this acoustic environment. Accordingly, when these elements are radiated outward in such a diverging configuration, the audience perceives the source as having a physical element of motion along that direction.

Returning to the basic embodiment of FIG. 2, it will be noted that a permanent, rigid core or plate 26 has been used as a support for both the coils 30 and the flexible emitter diaphragm 38. This rigid core 26 and coil 30 operate as the primary means for establishing a variable magnetic field adjacent the core member. This core is fixed in position so that all movement in response to the magnetic repulsion can be applied to the resilient film.

The operation of this core should be distinguished from the function of a conventional speaker core which likewise serves to reciprocate a moving diaphragm. Unlike the permanent magnet of an acoustic speaker, there is no telescopic core or recess which receives a stator element. Instead, the core 26 of the present invention is a planar or curved body which establishes variable magnetic field in various positions along its length at each coil 30, thereby providing the necessary repulsion force on each of the juxtaposed rings 34 in the diaphragm 38. Unlike the acoustic cone or diaphragm of a conventional magnetic speaker, the illustrated movable diaphragm 38 is disposed or stretched along and displaced a short separation distance from the core member 26 to allow an intended range of orthogonal displacement of the diaphragm within a strong portion of the magnetic field.

Typically, this diaphragm 38 comprises a thin film of Mylar® or other strong, lightweight polymer. Many such materials are already in use in the electrostatic speaker or ultrasonic emitter industry. Many of the techniques currently used for suspending the electrostatic film adjacent the electrostatic core can be transferred to the present invention for use with magnetic force fields. The operative difference between the present invention and prior art is that the electrostatic films must be positioned much closer to the power source, whereas a magnetic field allows greater separation distances from the film to the core. It will be apparent that this separation distance must be than half the total excursion path of the diaphragm to avoid undesireable contact of the film with the core structure.

The enhanced displacement of the diaphragm 38 is enabled by at least one, low mass, planar, conductive coil 30 disposed on the core 26, positioned so as to be adjacent a conductive ring 34 disposed on the movable diaphragm 38. Current flow within this thin, conductive coil 30 creates a magnetic field which induces current in the adjacent conductive ring. The resulting counter-magnetic force displaces the ring 34 from the coil 30, thus, yielding the benefits of substantial diaphragm displacement significantly far beyond the range of motion of prior electrostatic speaker systems.

As indicated above, this current is supplied to the coil 30 by first and second leads 32 which are coupled to a power source 42. The leads 32 provide electrical contact with the power source 42 so that variable current can pass through the coil and create a variable magnetic field which eminates from the core. The illustrated embodiment of FIG. 3 shows the leads 32 penetrating the core 26 and extending to the power source 42 for closing the circuit and allowing current flow in the coil 30. Audio signal 43 may be modulated on the alternating current from the power source 42 to provide the desired audio output. In this embodiment, that audio signal is buried with the mixed heterodyning wave form which emaninates from the film 38 as ultrasonic output 43*a*.

The rings 34 may be placed on the diaphragm 38 by many procedures well known in the art. For example, multiple conductive rings 34 can be simultaneously vapor deposited on a Mylar film with a template or mask. Similarly, the rings may be printed individually, or concurrently, with multiple print heads or plates. The reverse process can also be implemented with various etching techniques wherein the rings remain after a metallic coating is etched from the film by laser or chemical reaction. Other forms of application or deposition may be applied in accordance with conventional methods.

Both vapor deposition and etching techniques provide very thin or fine rings 34 which respond to the desired magnetic fields produced by the rings 30. Unlike magnetic fields used in the speaker industry which utilize three dimensional voice coils having hundreds of wrappings of wire and adding substantial mass, one embodiment of the present invention adopts a single plane for the ring 30, relying on the induced current to develop the counter magnetic force for repulsion. Typical ring patterns comprise thin line dimensions of approximately 10 to 100 micrometers, but may include line dimensions of several millimeters. Ring diameters may extend from several millimeters to several inches, depending upon the speaker configuration. It is to be noted that the reference to specific dimensions is not to be considered limiting. The principles of the present invention can in fact be with spacial limitation.

The selection of material for placement on the film is important. As indicated previously, the efficiency of the present invention is partially determined by the heat and temperature generated by the currents within the coils and rings. Therefore, a factor in selecting materials must include consideration of resistivity and heat generation. Aluminum, copper and other conventional nonferrous conducting materials may be applied. Preference, however, must be given to high conductivity, low resistivity materials. Selection of such materials must be balanced with the practical limitation of use as part of a speaker system. Liquid nitrogen cooling baths are generally impractical for a commercial speaker and accordingly limit the application of most superconductivity compositions. Progress with room temperature superconductors of ceramic and other materials offer promise for applications in this field.

Utilization of the coils 30 of the present invention enables the addition of very little weight to the diaphragm 38, allowing a low mass speaker system capable of oscillating at high ultrasonic frequencies, yet still having substantial orthogonal displacement. Essentially, the weight of the diaphragm 38 is slightly higher than the mass of the Mylar film itself, and is therefore closely comparable to an electrostatic membrane. Nevertheless, the power output of the coils 30 greatly exceeds that of an electrostatic speaker, giving far greater amplitude output.

Specific use of the present system for parametric speaker applications is most promising. As indicated above, the difficulty of obtaining higher level amplitudes in parametric speakers has been a major challenge. By supplying a variable current flow to the at least one coil 30 of the core 26, a constantly changing magnetic field is generated which variably interacts with the rings 34 to generate powerful opposing electromagnetic forces with respect to the magnetic force of the coil. The influence of the magnetic field of the core 26 on the rings 34 repels the diaphragm 38 at a desired frequency to establish a bias offset for the diaphragm, thereby providing displacement space for the diaphragm in response to the ultrasonic carrier wave and sidebands. It should be noted that because of the repulsion on both the positive and negative swings of the alternating current, the carrier frequency will double. Where this variable current source includes a carrier frequency which has been modulated with a voice or musical signal, a resulting dual ultrasonic frequency output is generated capable of emitting a new sonic emission in accordance with principles of acoustic heterodyning. Because of the increased orthagonal displacement of the film emitter, amplitude is greatly enhanced.

Figure 5:
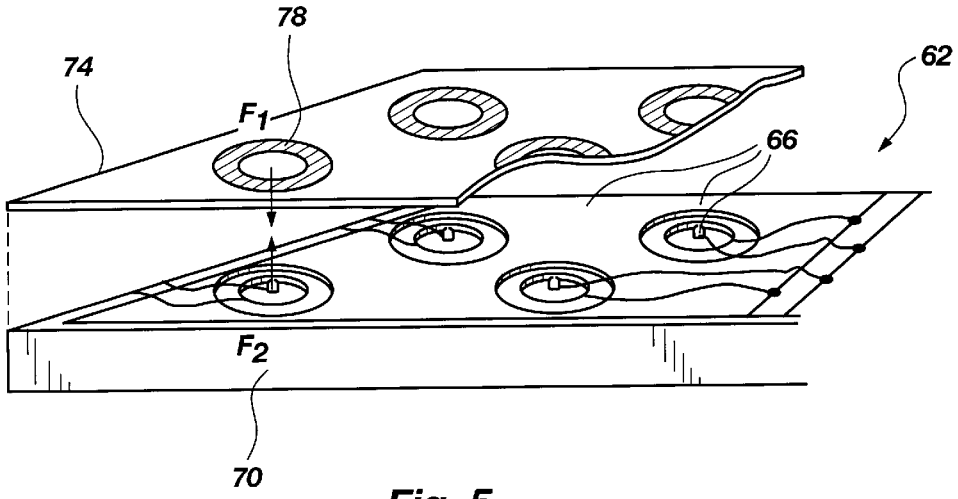
FIG. 5 is a graphic, elevational perspective view of a preferred embodiment of the present invention showing an emitter membrane disposed above compartmentalized solenoid coils.
Figure 6:
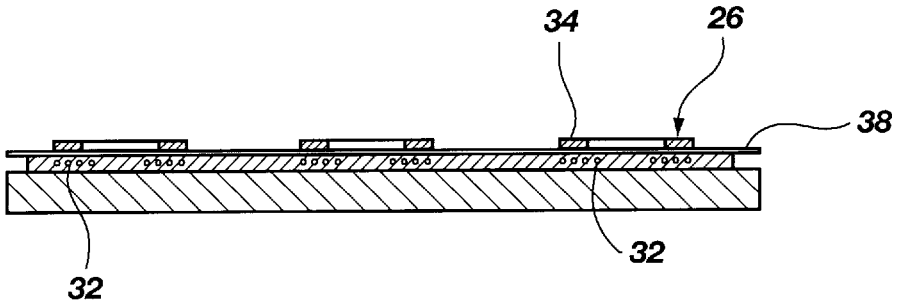
FIG. 6 is a cut-away profile view of the emitter diaphragm of FIG. 2, taken along the lines A—A.

Reference is now made to other embodiments of the subject ultrasonic emitter using magnetic forces to empower a film diaphragm. Where multiple rings are formed, it is possible to mechanically isolate each ring by providing a support perimeter in contact with the diaphragm around each of the conductive rings. One such technique is depicted in FIG. 5, wherein a grid configuration 62 defines a plurality of open displacement cavities 66 at a surface of the core member 70 adjacent to the diaphragm 74, each cavity being aligned with one of the conductive rings 78. Conductive coils 68 are centered in each of the grid cavities 66 to provide the necessary magnetic field for translating electrical signals into a vibrating emitter diaphragm 74. These displacement cavities 66 are of equal circular dimension to conform to the equally spaced rings 78 which they respectively support.

The advantages of isolating the respective rings 78 include reduction in anomalies within the vibrating diaphragm 74 which could arise from variations in physical properties of the film or diaphragm, as well as electrical properties which might propagate between rings from hysteresis or other forms of magnetic coupling that might be amplified by uninhibited transmission of vibrations between ring sectors and to optimally resonate mechanically at the desired bias frequency. The supporting grid members 75 operate to dampen such vibration where the diaphragm 74 is biased in contact with the grid face or edge surface. In this sense, each grid and ring sector becomes an autonomous speaker element which is controlled by the applied voltage. Where the voltage source is common, and the ring elements are congruent, the output should be equal. Consequently, all ring sectors having common output will generate a uniform wave front substantially free of distortion arising from physical or electrical perturbations.

Physical distortion can be further minimized by ensuring that the film material is uniform or isotropic in its response characteristics. In this manner, elongation or stretching of the material in response to repulsion forces remains uniform across the array of rings. In contrast with an electrostatic system wherein the force of electrostatic charges may be insufficient to fully displace the supporting film, the rings supply additional mass and magnetic repulsion to give full extension between relaxation phases.

These and other general design configurations are embodied in a method for emitting a broad frequency range including ultrasonic frequencies utilizing a vibrating diaphragm or film comparable to an electrostatic diaphragm. The method offers greatly increased audio amplitude because of a greatly enhanced capacity for relatively large diaphragm displacement as compared to lesser movement of a typical electrostatic diaphragm movement. This method comprises the basic steps of (i) providing a variable magnetic field adjacent a supporting core member; (ii) applying at least one conductive ring to a movable diaphragm stretched along and displaced a short separation distance from the core member and within a strong portion of the variable magnetic field; and (iii) developing a counter electromagnetic force within the at least one ring to repel the diaphragm at a desired frequency for development of a series of compression waves which may be adjusted to include an ultrasonic frequency range. It will be noted that many of the variations discussed above can be implemented within the subject method in procedures that will be readily apparent to those skilled in the art. Accordingly, further expansion of specific method steps on alternative embodiments is deemed unnecessary.

Regarding both the apparatus and method set forth above, it will be further apparent to those skilled in the art that certain basic design considerations will deserve attention in developing specific configurations for various magnetic coil and corresponding ring systems. For example, it is important to remember that the resonant frequency of the preferred embodiment shown herein is a function of various characteristics (referring to FIG. 5) of the vibrating diaphragm. These characteristics include, among other things, the thickness of the film 74 stretched across the support core 70, as well as the diameter of the grid cavities 62 in the core structure. Using a thinner film 74 will obviously result in more rapid vibrations of the film 74 for a given applied voltage. Consequently, the resonant frequency of the film 74 (or diaphragm) will be higher.

Figure 7:
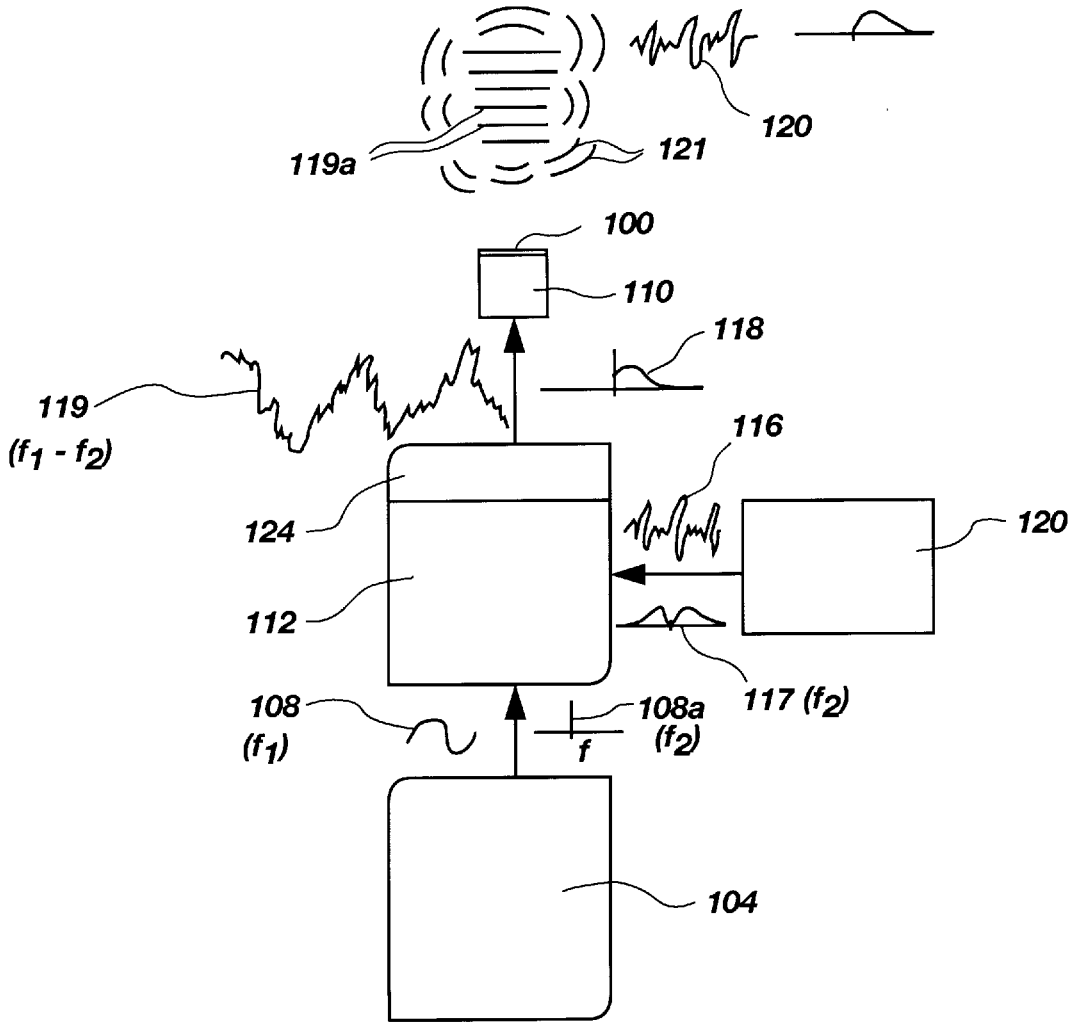
FIG. 7 is a more specific implementation of the present invention which simultaneously transmits an ultrasonic carrier frequency and an ultrasonic sideband frequency which acoustically heterodyne to generate a new sonic or subsonic frequency.

Turning to a more specific implementation of the preferred embodiment of the present invention as part of a parametric system, a magnetic diaphragm 100, as herein described, can be included in the system shown in FIG. 7 supported on a driver unit 110. This application utilizes a parametric or heterodyning technology, which is particularly adapted for the present thin film structure. The thin magnetic film of the present invention is well suited for operation at high ultrasonic frequencies in accordance with parametric speaker theory.

A basic system includes an oscillator or digital ultrasonic wave source 104 for providing a base or carrier wave 108. This wave 108 is generally referred to as a first ultrasonic wave or primary wave. An amplitude modulating component 112 is coupled to the output of the ultrasonic generator 104 and receives the base frequency 108 for mixing with a sonic or subsonic input signal 116. The sonic or subsonic signal 116 may be supplied in either analog or digital form, and could be music from any convention signal source 120 or other form of sound. If the input signal 116 includes upper and lower sidebands 117, a filter component 124 may be included in the modulator to yield a single sideband output 118 on the modulated carrier frequency for selected bandwidths, represented by signal 119.

The magnetic diaphragm 100 is caused to emit the ultrasonic frequencies $f_1$ and $f_2$ as a new waveform 119*a* propagated at the face of the magnetic diaphragm 100. This new wave form interacts within the nonlinear medium of air 121 to generate the difference frequency 120, as a new sonic or subsonic wave. The ability to have large quantities of emitter elements formed in an emitter disk is particularly well suited for generation of a uniform wave front which can generate quality audio difference output at meaningful volumes.

The present invention is able to function as described because the ultrasonic signals corresponding to $f_1$ and $f_2$ interfere in air according to the principles of acoustical heterodyning. Acoustical heterodyning is somewhat of a mechanical counterpart to the electrical heterodyning effect which takes place in a non-linear circuit. For example, amplitude modulation in an electrical circuit is a heterodyning process. The heterodyne process itself is simply the creation of two new waves. The new waves are the sum and the difference of two fundamental waves.

In acoustical heterodyning, the new waves equaling the sum and difference of the fundamental waves are observed to occur when at least two ultrasonic compression waves interact or interfere in air. The preferred transmission medium of the present invention is air because it is a highly compressible medium that responds non-linearly under different conditions. This non-linearity of air enables the heterodyning process to take place, decoupling the difference signal from the ultrasonic output. However, it should be remembered that any compressible fluid can function as the transmission medium if desired.

Whereas successful generation of a parametric difference wave in the prior art appears to have had only nominal volume, the present configuration generates full sound. This full sound is enhanced to impressive volume levels because of the significant increase in orthogonal displacement of the emitter diaphragm.

The development of full volume capacity in a parametric speaker provides significant advantages over conventional speaker systems. Most important is the fact that sound is generated in air via a relatively massless radiating element. Specifically, there is no radiating element operating within the audio range because the film is vibrating at ultrasonic frequencies. This feature of sound generation by acoustical heterodyning can substantially eliminate distortion effects, most of which are caused by the radiating element of a conventional speaker. For example, adverse harmonics and standing waves on the loudspeaker cone, cone overshoot and cone undershoot are substantially eliminated because the low mass, thin film is traversing distances in millimeters.

It should also be apparent from the description above that the preferred and alternative embodiments can emit sonic frequencies directly, without having to resort to the acoustical heterodyning process described earlier. However, the greatest advantages of the present invention are realized when the invention is used to generate the entire range of audible frequencies indirectly using acoustical heterodyning as explained above.

It is to be understood that the above-described embodiments are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed and desired to be secured by United States Letters Patent is:

1. An ultrasonic emitter device having broad frequency range capacity with relatively large diaphragm displacement compared to typical electrostatic diaphragm movement, said device, comprising:

a core member containing means for establishing a variable magnetic field adjacent the core member;

a movable diaphragm disposed in tension along the core member and displaced a short separation distance from the core member to allow an intended range of orthogonal displacement of the diaphragm with respect to the core member and within a strong portion of the variable magnetic field; and at least one conductive ring disposed on the movable diaphragm for enabling inductively induced current flow in an orientation which develops a counter, opposing magnetic force which is repelled by the variable magnetic field of the core member at a desired frequency for development of a series of compression waves which may be adjusted to include an ultrasonic frequency range.

2. A device as defined in claim 1, wherein the core member comprises an electromagnet.

3. A device as defined in claim 2, wherein the electromagnet comprises a rigid plate having dimensions slightly larger than dimensions of an active emitting surface of the emitter device.

4. A device as defined in claim 3, wherein the rigid plate comprises a flat plate with uniform variable magnetic field along a surface of the plate most adjacent the movable diaphragm.

5. A device as defined in claim 2, wherein the electromagnet comprises a flexible plate.

6. A device as defined in claim 1, wherein the core member comprises a rigid plate formed of nonmagnetic composition, one surface of the plate including at least one opposing conductive coil having first and second contacts for enabling current flow through the conductive coil.

7. A device as defined in claim 6, wherein the at least one conductive coil is positioned on the rigid plate in a location which is juxtaposed to the at least one conductive ring on the movable diaphragm to enable the at least one conductive coil and at least one opposing conductive ring to cause opposing magnetic fields to interact to develop the compression waves.

8. A device as defined in claim 7, wherein the means for supplying variable current flow includes control means for coordinating current flow to the at least one conductive coil such that the at least one conductive coil generates a variable magnetic field which is capable of enhancing repulsion arising between the at least one coils and at least one ring.

9. A device as defined in claim 1, wherein the diaphragm comprises a thin film, said at least one ring being disposed on one side of the film.

10. A device as defined in claim 9, wherein the film comprises a polymer having isotropic resilient properties across its surface to provide a uniform response to applied tension.

11. A device as defined in claim 10, wherein the polymer comprises Mylar.

12. A device as defined in claim 9, wherein the ring is made of a composition selected from the group consisting of conductive metals, conductive ceramics and superconductive materials.

13. A device as defined in claim 1, wherein the ring is deposited on the diaphragm as a conductive element by vapor deposition.

14. A device as defined in claim 1, comprising a plurality of conductive rings disposed on the diaphragm.

15. A device as defined in claim 14, wherein the plurality of conductive rings are equally spaced along the diaphragm.

16. A device as defined in claim 15, wherein the plurality of conductive rings are disposed in a plurality of rows.

17. A device as defined in claim 1, further comprising a support perimeter in contact with the diaphragm around each of the at least one conductive ring.

18. A device as defined in claim 17, comprising a plurality of conductive rings, each ring including a support perimeter in contact with the diaphragm and providing means for substantially isolating displacement of the diaphragm at each ring from adjacent rings.

19. An ultrasonic emitter device having broad frequency range capacity with relatively large diaphragm displacement compared to typical electrostatic diaphragm movement, said device, comprising:

a core member having means for establishing a variable magnetic field adjacent the core member;

a movable diaphragm disposed in tension along the core member and displaced a short separation distance from the core member to allow an intended range of orthogonal displacement of the diaphragm with respect to the core member and within a strong portion of the variable magnetic field;

a plurality of conductive rings disposed on the movable diaphragm for enabling current flow in an orientation which develops a counter, opposing magnetic force which is repelled by the variable magnetic field of the core member at a desired frequency for development of a series of compression waves which may be adjusted to include an ultrasonic frequency range;

a support perimeter, in contact with the diaphragm and providing means for substantially isolating displacement of the diaphragm at each ring from adjacent rings, wherein the support perimeter for isolating the rings comprises a grid configuration defining a plurality of open displacement cavities at a surface of the core member adjacent to the diaphragm, each cavity being aligned with one of the conductive rings.

20. A device as defined in claim 19, wherein the displacement cavities are of equal circular dimension.

21. A device as defined in claim 19, wherein the core includes means for generating a biasing magnetic field having a continuously oscillating strength selected to provide a biasing force on the diaphragm responsive to the magnetic field developed within the at least one conductive coil to displace the diaphragm to a baseline displacement and tension.

22. A device as defined in claim 1, wherein the core comprises an electromagnetic composition and includes means for supplying an alternating current to the means for establishing a variable magnetic field for developing an electromagnetic force inside the core which is operable with respect to the at least one conductive ring to develop the desired diaphragm displacement.

23. A device as defined in claim 22, wherein a plurality of conductive rings are disposed on the diaphragm and develop a collective response to the electromagnetic force of the core to generate the desired relatively large diaphragm displacement.

24. A device as defined in claim 1, wherein the means for establishing the variable magnetic field adjacent the core comprises at least one conductive coil positioned on the core adjacent the at least one conductive ring of the diaphragm.

25. A device as defined in claim 24, comprising a plurality of first conductive rings on the diaphragm and a corresponding plurality of second conductive rings juxtaposed to the first conductive rings on an opposing side of the diaphragm.

26. A device as defined in claim 24, wherein the means for providing the variable magnetic field comprises an alternating current source.

27. A device as defined in claim 26, wherein the plurality of coils of the core are aligned with the plurality of rings of the diaphragm.

28. A method for emitting a broad frequency range including ultrasonic frequencies, yet having a capacity for relatively large diaphragm displacement as compared to lesser movement of a typical electrostatic diaphragm movement, the method comprising the steps of:

(a) providing a continuously variable magnetic field adjacent a supporting core member;

(b) maintaining a movable diaphragm having at least one conductive ring thereon in stretched configuration along the core member and displaced a short separation distance from the core member to allow an intended range of orthogonal displacement of the diaphragm with respect to the core member and within a strong portion of the variable magnetic field; and (c) inductively coupling the variable current flow within the at least one coil with the at least one ring for developing a second magnetic field which variably interacts with the first magnetic field to repel the diaphragm at a desired frequency for development of a series of compression waves which may be adjusted to include an ultrasonic frequency range.

29. A method as defined in claim 28, wherein the step of supplying the continuously variable magnetic field at the core comprises developing an alternating current within conductive coils coupled to the core to generate a resulting variable magnetic field for repelling the diaphragm, said alternating current providing a momentary relaxation period to allow the diaphragm to resume a rest position which is slightly biased in tension.

30. A method as defined in claim 29, wherein the supplying step comprises developing the alternating current at a frequency corresponding to a frequency range within the ultrasonic bandwidth.

31. A method as defined in claim 29, wherein the alternating current includes a fixed carrier frequency portion within the ultrasonic frequency range, plus a sonic frequency modulated with the carrier frequency to generate at least two ultrasonic frequencies whose difference in value corresponds to the sonic frequency.

32. A method as defined in claim 31, further comprising the step of applying the fixed carrier frequency to bias the diaphragm to a displacement distance from the core member wherein the diaphragm is in tension, but capable of further displacement in response to the two ultrasonic frequencies to generate compression waves within the ultrasonic frequency range which interfere in air to develop a sonic output.

* * * * *